US007507195B2

(12) United States Patent
Hamano

(10) Patent No.: US 7,507,195 B2
(45) Date of Patent: Mar. 24, 2009

(54) METHOD OF MANUFACTURING A FOOD CONTAINER

(75) Inventor: Shinkichi Hamano, Tokyo (JP)

(73) Assignee: Isamu Sato, Tokyo (JP)

( * ) Notice: Subject to any disclaimer, the term of this patent is extended or adjusted under 35 U.S.C. 154(b) by 0 days.

(21) Appl. No.: 11/823,282

(22) Filed: Jun. 27, 2007

(65) Prior Publication Data

US 2008/0045392 A1 Feb. 21, 2008

Related U.S. Application Data

(63) Continuation-in-part of application No. 11/472,682, filed on Jun. 22, 2006, now abandoned.

(30) Foreign Application Priority Data

Jun. 23, 2005 (JP) ..... 2005-183903

(51) Int. Cl.
*B31B 1/62* (2006.01)

(52) U.S. Cl. ..... 493/141; 493/148; 493/162; 428/34.02; 428/35.6

(58) Field of Classification Search ..... 53/453, 53/456, 561, 559; 493/52, 114, 141, 148, 493/168; 428/34.1, 34.2, 35.6, 35.7
See application file for complete search history.

(56) References Cited

U.S. PATENT DOCUMENTS 2,292,403 A * 8/1942 Peters ..... 53/456
2,620,963 A 12/1952 Hagopian
3,240,611 A * 3/1966 Williams ..... 53/456
4,026,458 A * 5/1977 Morris et al. ..... 229/182.1
4,930,681 A * 6/1990 Fultz et al. ..... 229/114
5,044,549 A * 9/1991 Beales ..... 229/125.27
5,226,587 A * 7/1993 Eisman et al. ..... 229/110
5,577,989 A * 11/1996 Neary ..... 493/169
6,527,687 B1 * 3/2003 Fortney et al. ..... 493/56
6,676,010 B1 * 1/2004 Roseth et al. ..... 229/114
7,037,471 B1 * 5/2006 Perlman ..... 422/102
2002/0113118 A1 * 8/2002 Littlejohn et al. ..... 229/407
2006/0003119 A1 * 1/2006 Aiba ..... 428/34.2

* cited by examiner

*Primary Examiner*—Paul R Durand
(74) *Attorney, Agent, or Firm*—Jordan and Hamburg LLP

(57) ABSTRACT

Method of manufacturing a food container or cover includes the steps of: forming a paperboard article from pulp and/or other vegetable fiber material; coating front surface or back surface of the paperboard article with heat sealable thermoplastic resin; forming foldout pieces for connecting adjacent sidewall pieces at four corners of the paperboard article; and forming the food container or cover by hot-pressing the paperboard article thus obtained between a pair of male and female press dies. One mutually opposed pair of the sidewall pieces is configured to be erected before the other mutually opposed pair of the sidewall pieces. The V-shaped foldout pieces include a V-shaped foldout portion shorter than portions that are adjacent to both side portions on the foldout piece, and the V-shaped foldout piece is overlapped or stuck to an adjacent one side of the foldout piece or sidewall piece.

17 Claims, 6 Drawing Sheets

METHOD OF MANUFACTURING A FOOD CONTAINER

REFERENCE TO RELATED APPLICATION

This is a continuation-in-part of Ser. No. 11/472,682 filed Jun. 22, 2006.

BACKGROUND OF THE INVENTION

The present invention relates to a method of manufacturing food containers or covers formed of vegetable fiber material, more specifically, to a method of manufacturing the food container or covers formed of the vegetable fiber material commercially at low cost.

Conventional food containers for containing food, such as lunch boxes or trays, are made of plastic materials like foamed polyurethane and so on. However, since the plastic materials have a problem in disposing them after use, vegetable-fiber-made food containers are strongly required in view of environmental conservation.

However, there has been a problem in manufacturing the vegetable-fiber-made food containers by die molding process in that only shallow containers with insufficient strength could be manufactured. Further, in the case of the containers made from pulp board, there has been a problem of costly manufacturing, since the containers are so manufactured that cuts are formed at four corners, sidewall pieces are erected, edges of the sidewall pieces are brought into superposition to each other to apply bonding agent, and the bonded portions are manually fixed. As a consequence thereof, the vegetable-fiber-made food containers are not widely distributed comparing to the other food containers, e.g., cheap trays as presently sold in supermarkets.

In addition, paper-made containers that have a number of bellows-like wrinkles formed at the corner portions and the surface is coated with film have also been known. However there has been a problem of extremely expensive cost.

Meanwhile, with regard to paper as vegetable-fiber-made material, the natural forest including the virgin forest is to be deforested for raw material of paper. However, it is a current issue to deforest the natural or virgin forest not only from view point of natural ecosystem where various animals inhabit but also from local environmental disruption view point.

SUMMARY OF THE INVENTION

An object of the present invention is to provide a method of manufacturing a vegetable-fiber-material made food container which has a practical strength and can be manufactured commercially at low cost.

Another object of the present invention is to provide a method, considering a problem as to a global environment, of manufacturing the vegetable-fiber-material made food container at low cost, capable of reducing an amount of pulp to be used therefor.

The above stated objects can be achieved with the present invention by employing the steps of: forming a board of a predetermined size from at least one kind of material selected from the group of pulp and vegetable fiber material other than pulp; coating either of front surface or back surface of the paperboard article with thermoplastic resin having a heat sealing property;forming foldout pieces for connecting adjacent sidewall pieces at four corners of the paperboard article; and forming the food container or cover by hot-pressing the paperboard article thus obtained between a pair of male and female press dies; wherein one pair of the sidewall pieces opposed to each other is configured to be erected ahead of the other pair of the sidewall pieces opposed to each other; the V-shaped foldout pieces include a V-shaped foldout piece shorter than portions that are adjacent to both side portions on the foldout piece, and the V-shaped foldout piece is overlapped or stuck to an adjacent one side of the foldout piece or sidewall piece.

It is preferable to form the foldout portions for connecting so as to be bonded with the sidewalls in a state that the foldout portions are folded uprightly. It is also preferable to form the foldout portions to be substantially V-shaped to bond in overlapping manner with the sidewalls after folding at the center of the V-shape to form a pyramidal shape which collapses to put the both sides together.

In this case, a notch is formed at the top end of the foldout portion on the abutting side of the same against the one sidewall in overlapping manner for bonding, after the substantially V-shaped foldout portion is folded at the center thereof in a pyramidal shape, so that the rear surface of the other side of the foldout portion is directly abutted for bonding against the front surface of aforementioned one sidewall.

Moreover, especially in the case where to fold up the foldout portion in a smaller angle below 90 degrees, it is preferable to form the foldout portion for connecting in substantially V-shape and fold it as V-shape to bond in overlapping manner with the sidewall. In this case, a notch is formed at the top end of the substantially V-shaped foldout portion so that the front surface of the sidewall with which the foldout portion is bonded in overlapping manner and the rear surface of the other sidewall interposing the notch therebetween are abutted to be bonded together. In the present invention, coating of thermoplastic resin having heat sealing property on the front or rear surface only can perform bonding the corner portion effectively.

Such an arrangement that a protruded portion is formed at one of the opposing sections of an recess perimeter of the female die so that the pair of opposing sidewall pieces placed on the protruded portion is erected earlier than the other pair of the opposing sidewall pieces can make it possible to manufacture food containers commercially at low cost, four corners of containers being attached together through the hot press process using dies.

In a case of manufacturing the container with lip sections, the opposing protruded portions are configured so as to be away from the concaved periphery of the female die at least by a distance corresponding to the lip sections of the container to be formed.

Before the pressing process, if one pair of the opposing sidewall pieces, which are arranged to be erected prior to the other pair of the opposing sidewall pieces, is bent, conventional dies can be employed to manufacture the container. However, when considering productivity of the manufacturing method, the above stated arrangement will be more preferable to produce the container.

It is preferable that the pulp and at least one kind of the vegetable fiber material other than the pulp are made of mixture of the pulp and the vegetable fiber material other than the pulp in order to minimize global environment destruction due to deforestation. To minimize cost, it is preferable to use wastepaper(pulp) alone.

It is preferable that the vegetable fiber material other than the pulp be made of reed, sugar cane or kanaf.

It is preferable to employ polyethylene or polypropylene as the thermoplastic resin having the heat sealing property according to the present invention.

DETAILED DESCRIPTION OF THE INVENTION

Figure 1:
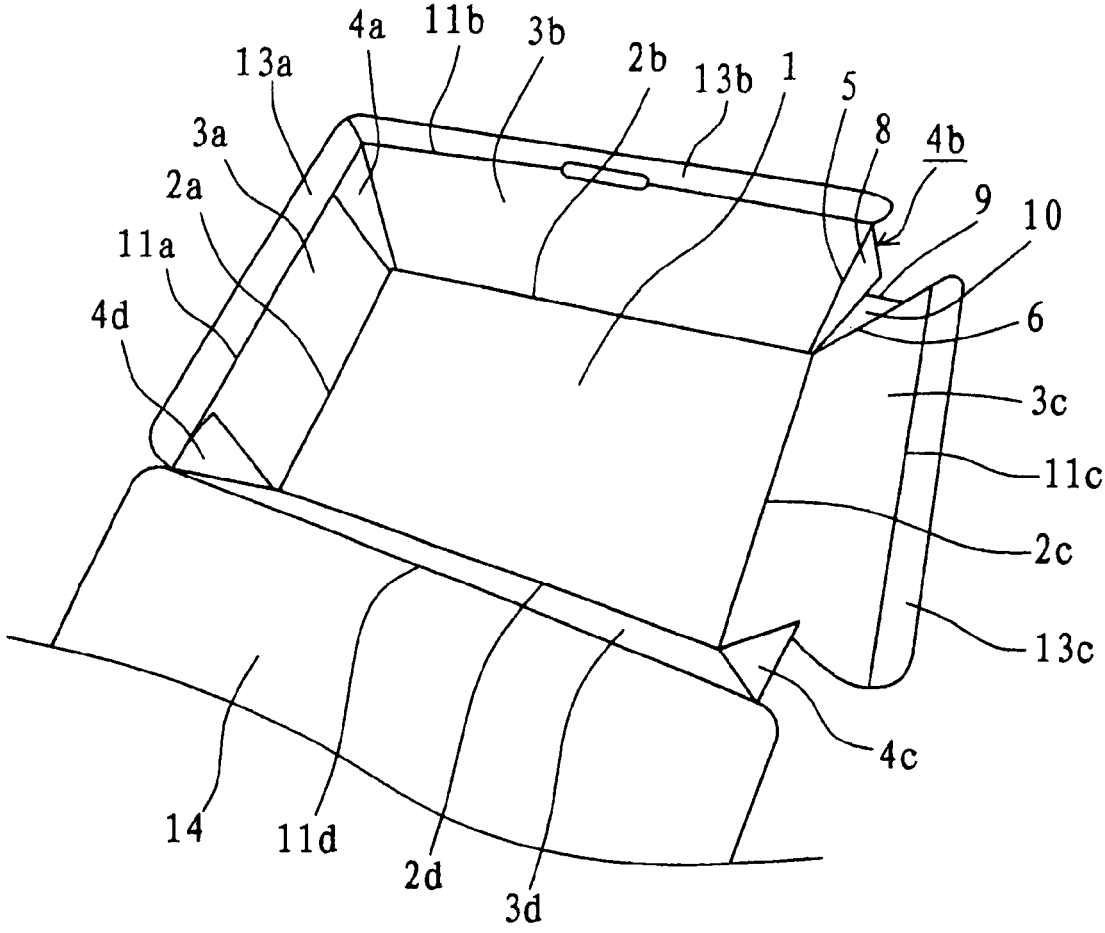
FIG. 1 is a perspective view illustrating one embodiment of a food container according to the present invention.

Next an embodiment of the present invention is described.

The present invention is composed of the following processes.

(1) The paperboard of the predetermined size is formed from one or more kinds of pulp and vegetable fiber materials other than the pulp.

(2) Thermoplastic resin having the heat sealing property is applied to the paperboard.

(3) Folding lines are formed on the aforementioned board.

(4) Thus obtained paperboard is subjected to the hot press process using a pair of press dies, male and female in order to form the food container.

The process (1) can be performed by a known method of manufacturing the paperboard from pulp. More specifically, the paperboard is obtainable through the processes that pulp suspended in water is subjected to a sheet-forming process, followed by a water-squeezing process and drying process. The paperboard thus obtained is cut into developed shape of a container or a cover thereof to be formed. It is preferable that the paperboard contain water proof agent.

As the vegetable-fiber-made material other than the pulp used in the present invention, it is preferable to use reed, sugar cane or kenaf. More specifically, using the reed is preferred since it imparts excellent strength to the resultant container.

In the present invention, it is preferable to use a mixture of the pulp and the vegetable fiber material other than the pulp in order to minimize destruction of the global environment due to the deforestation.

As to the proportions of the pulp and the vegetable fiber material other than the pulp, it is preferable that the vegetable fiber material other than the pulp be between 20 and 80 wt %, more preferably between 30 and 60 wt %. The less addition of the vegetable fiber material, the less effect in protection of the global environment, while the more addition of the vegetable fiber material, the less strength and the more tendency of abruption of the bonding section.

The process (2) in which the thermoplastic resin having the heat sealing property is coated onto the paperboard may be done after a formation of the cuts or may be done before the formation of the cuts; however, the coating process is done before the formation of the cuts in the present embodiment. The thermoplastic resin is applied to either surface, front or rear, of the paperboard. If the thermoplastic resin is applied to both surfaces, paperboard sticks to a die. In addition, the thermoplastic resin is preferred to be applied to the surface on which the food is placed. The reason for applying coating on the surface on which the food is placed is that the coating prevents juice or the like from infiltrating into the container. As the thermoplastic resin, it is preferable to use especially polyethylene or polypropylene. Still, when you complete a film on the container surface, you had better coat it on the container back side.

A content of the thermoplastic resin differs depending on the kinds of the thermoplastic resin. In particular, that content is a range between 2 and 10% with respect to a mass of the paperboard, more preferably, between 3 and 6% with respect to the mass of the paperboard. Here, the "content" is represented by a percentage of the "mass of the heat sealing agent to be applied to the paperboard" with respect to the entire mass of the paperboard of which one surface is applied with the thermoplastic resin.

The foldout line in the process (3) is preferably formed by a blanking die. That is, the folding lines between the bottom and the side, the side and the foldout portion, and the like are formed by pressing a paperboard placed on a blanking die having projected lines thereon, whereby the folding lines are formed. As a matter of course, other means may be applicable to form the folding lines.

FIG. 1 is a perspective view illustrating one embodiment of a food container according to the present invention. Note that, for convenience of explanation, a part of the sidewall is shown in a state developed.

The sidewalls (side plane pieces) 3*a*, 3*b*, 3*c* and 3*d* are provided consecutively with the bottom plate 1 via the folding lines 2*a*, 2*b*, 2*c* and 2*d*. The adjacent sidewalls 3*a*/3*b*, 3*b*/3*c*, and 3*c*/3*d* are connected with the foldout portions 4*a*, 4*b*, 4*c* and 4*d* via the folding lines 5 and 6.

The foldout portions 4*a* to 4*d* are formed in substantially V-shape and a folding line 7 is formed at the center of the V-shape so that the folding line can be folded towards inside of the container in a pyramidal shape. The foldout portions 4*a* to 4*d* are composed of a long substantially V-shaped foldout portion 8 and a short substantially V-shaped foldout portion 10 having a notch 9 formed at the upper top thereof.

Since the above mentioned food container is coated with the thermoplastic resin having the heat sealing property only on the front surface, the long substantially V-shaped foldout portion 8 and the short substantially V-shaped foldout portion 10 are not bonded to fix unless the notch 9 is formed. In the above embodiment, since the notch 9 is formed, the top of the long substantially V-shaped foldout portion 8 and the sidewall 3*c* are bonded, and consequently the long substantially V-shaped folding portion 8 and the short substantially V-shaped folding portion 10 are fixed.

The lip portions 13*a*, 13*b* and 13*c* are provided on the top end of the sidewalls 3*a*, 3*b* and 3*c* via the folding lines 11*a*, 11*b* and 11*c*, and the sidewall 3*d* is provided with a cover 14 via the folding line 11*d*.

In FIG. 1, when the sidewall 3*b* is erected, both the long V-shaped piece 8 and the short V-shaped piece 10 are erected together, and the short V-shaped piece 10 comes into contact with the rear surface of the long V-shaped piece 8, which is bonded to the sidewall 3*c*. When comparing the long V-shaped piece 8 with the short V-shaped piece 10, the edge of piece 10 is designed to be shorter than that of piece 8. This was expressed as a notch 9. Since the notch 9 was provided in this manner, the part of the rear surface of the long V-shaped piece 8 taller than the short V-shaped piece 10 is bonded to the front surface of the sidewall 3*c* at the same time.

As described above, the short V-shaped piece 10 is bonded to the front surface of the sidewall 3*c*, and the rear surface of the long V-shaped piece 8 is bonded to the front surface of the sidewall 3*c*. If the notch 9 is not provided, pieces 8 and 10 are not bonded to any part because the rear surfaces of pieces 8 and 10 are not coated with polymer.

In FIG. 1, when the sidewalls 3*a*, 3*c* are erected, the short V-shaped piece 10 and the long V-shaped piece 8 are erected together, and the short V-shaped piece 10 comes into contact with the front surface of the long V-shaped piece 8 to be bonded thereto. The front surface of the part of the front surface of the long V-shaped piece 8 taller than the short V-shaped piece 10 is bonded to the rear surface of the sidewall 3*c* at the same time.

Figure 2:
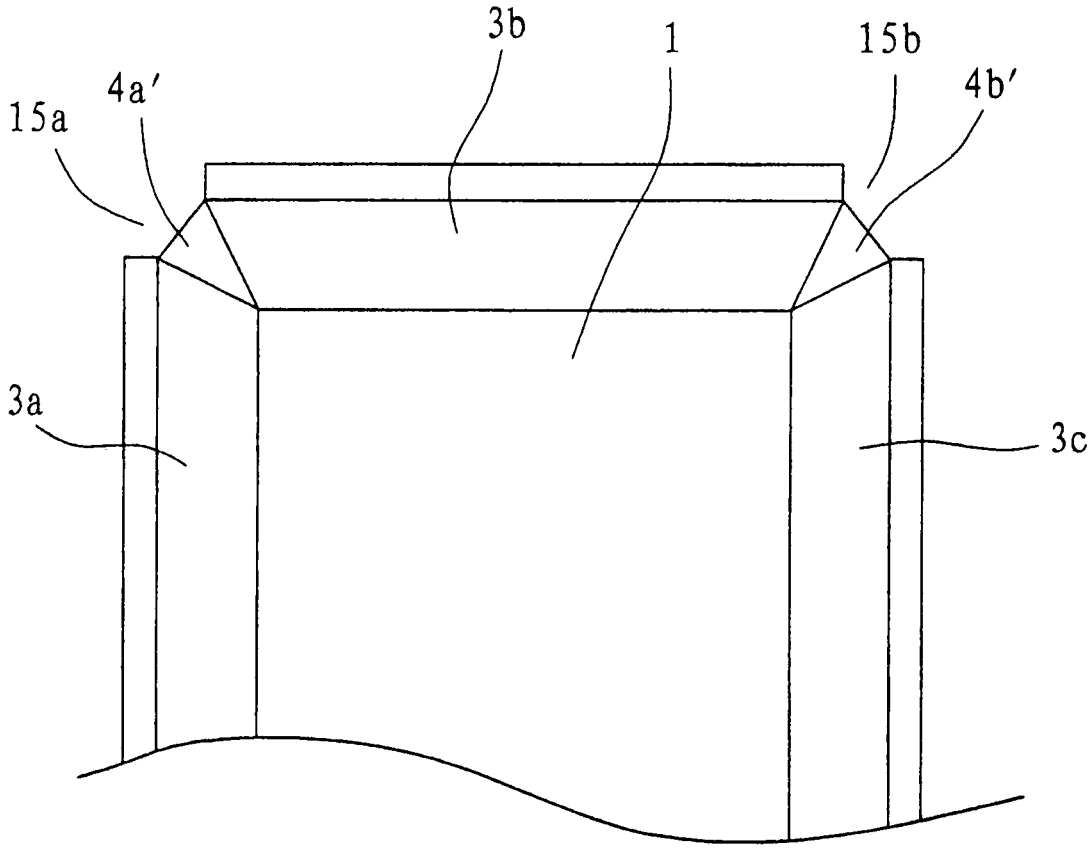
FIG. 2 is a partial developed view illustrating another embodiment of a food container according to the present invention.

FIG. 2 shows another embodiment according to the present invention. Folding pieces 4*a*' and 4*b*' connecting the sidewalls 3*a* and 3*b*, and 3*b* and 3*c* respectively are formed in substantially V-shape, and the folding portions 4*a*' and 4*b*' are arranged to be folded as V-shape and then bonded with the sidewall 3*a*, 3*c* or 3*b* in overlapping manner.

At the top end of the substantially V-shaped foldout portions 4*a*' and 4*b*', the notches 15*a* and 15*b* are formed. The long front surface part than foldout portion of the sidewall on which the folding portion is overlapped for bonding thereto and the rear surface of the other sidewall interposing the aforementioned notch are arranged to be abutted for bonding.

In order to form the food container by means of a pair of hot press dies consisted of the male die and the female die in accordance with the process (4), one of the pairs of the opposing sidewall pieces of the paperboard on which cuts are formed as illustrated in FIGS. 1 to 2 is erected prior to the other pair of the opposing sidewall pieces and the paperboard thus formed is placed in the female die to be subjected to a hot pressing process by the upper male die in order to form the container, and simultaneously, the paperboard is subjected to the heat sealing process If the sidewall pieces are preliminary erected by means of a paper foldout machine, conventional press dies can also be utilized to form the container.

Figure 4:
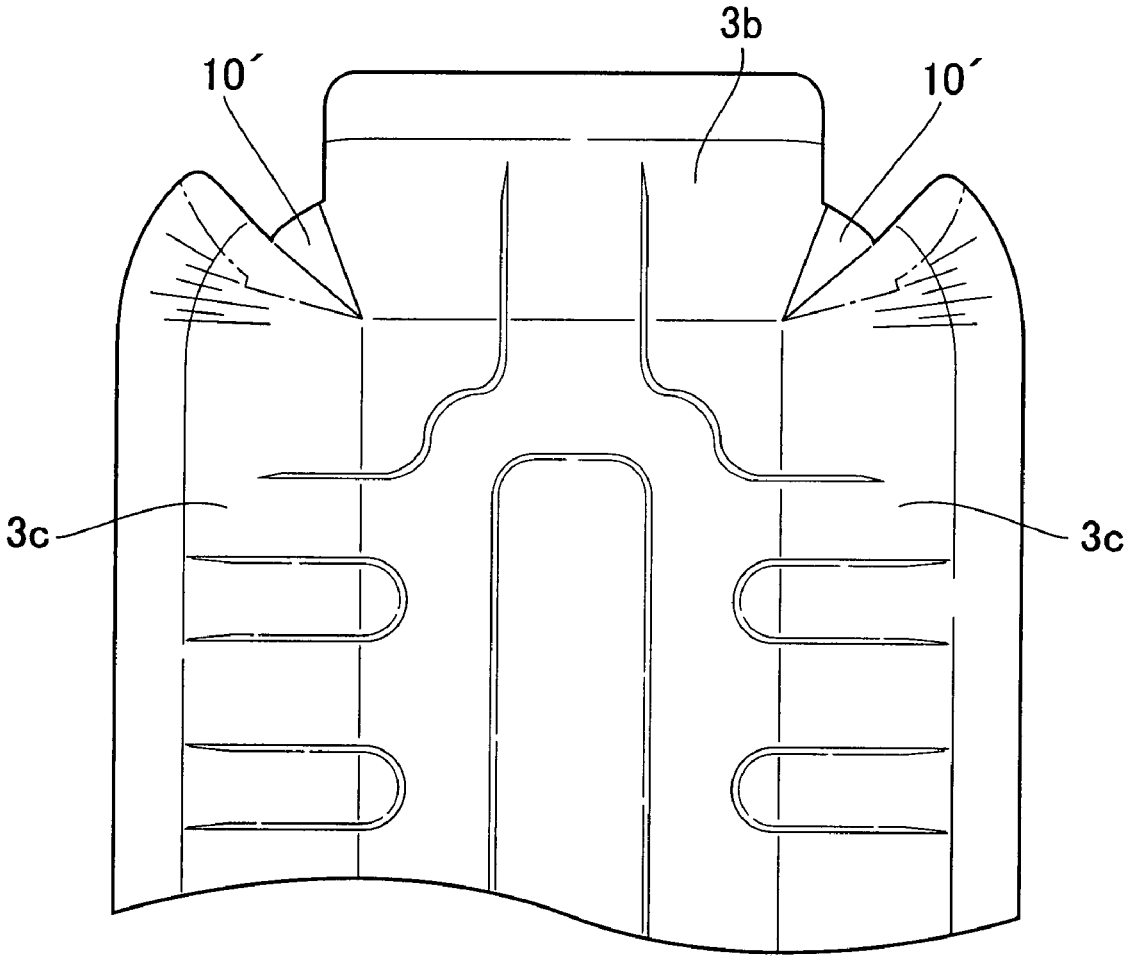
FIG. 4 is a partial developed view illustrating another embodiment of a food container according to the present invention.
Figure 5:
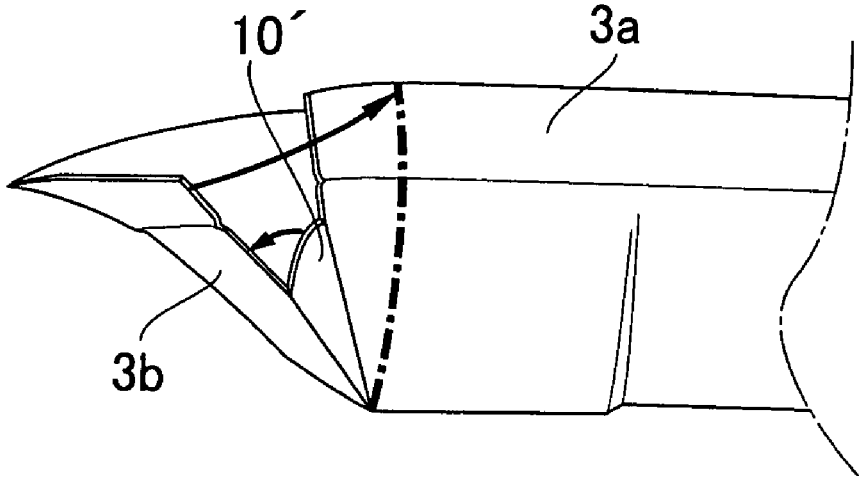
FIG. 5 is a perspective view illustrating the state in which a short V-shaped piece in FIG. 4 is bonded to one sidewall.
Figure 6:
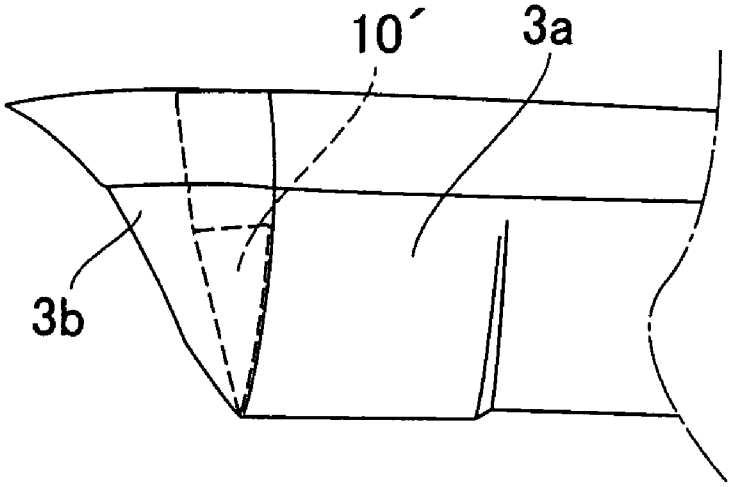
FIG. 6 is a perspective view illustrating the state in which a short V-shaped piece in FIG. 4 is bonded to the other sidewall.

FIG. 4 illustrates another embodiment of the present invention. In FIG. 4, when the sidewalls 3*a*, 3*c* are erected, the short V-shaped pieces 10' are erected together, and then, as shown in FIGS. 5 and 6, the short V-shaped piece 10' is bonded to the front surface of the sidewall 3*b* as shown by the arrow. The front surface of the part of the sidewall 3*b* taller than the short V-shaped piece 10' is bonded to the rear surface of the sidewall 3*a*, 3*c* at the same time.

Figure 7:
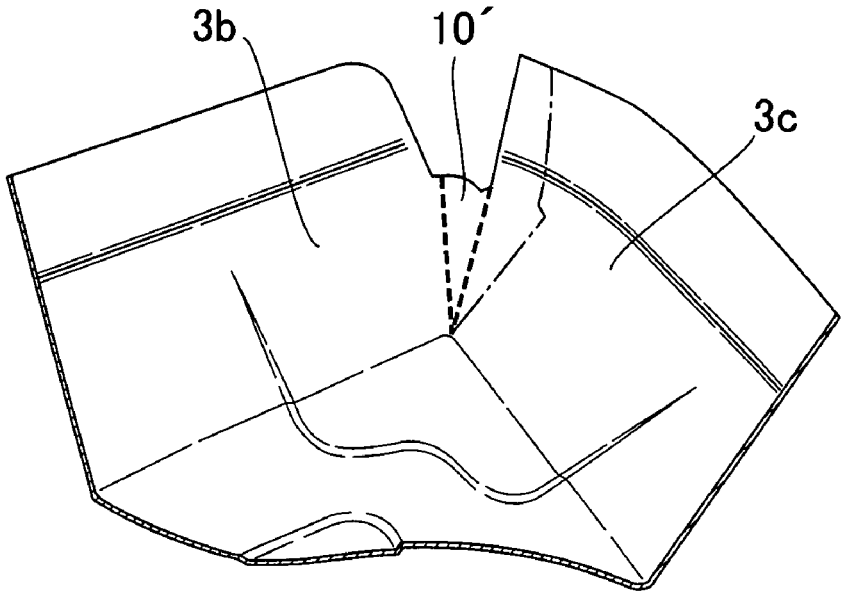
FIG. 7 is a perspective view illustrating the state in which a short V-shaped piece is bonded to the other sidewall.
Figure 8:
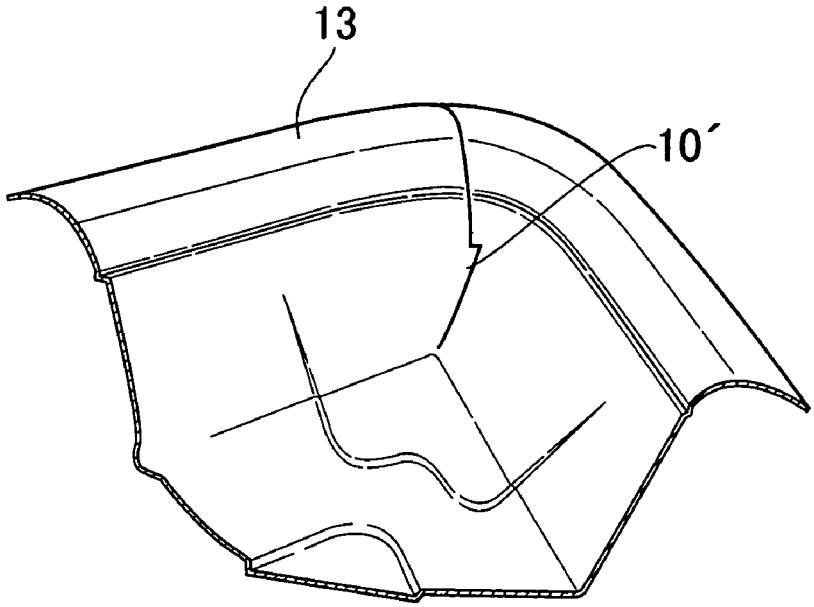
FIG. 8 is a perspective view illustrating the state in which the sword-guard shaped portion is formed.

In FIG. 4, when the sidewall 3*b* is erected ahead, the short V-shaped piece 10' is also erected together, and then, as shown in FIG. 7, the short V-shaped piece 10' is bonded to front surfaces of the sidewalls 3*a*, 3*c*. The front surface of the part of the sidewalls 3*a*, 3*c* taller than the short V-shaped piece 10' is bonded to the rear surface of the sidewall 3*b* at the same time.

In the above-mentioned embodiment, thermoplastic resin having a heat sealing property is coated only on the front surface or rear surface of the paperboard. In the case the face is coated, the female die is heated, whereas in the case the rear surface is coated, the male die is heated. Such process helps to avoid the paperboard from adhering to the die.

If upper parts than the short V-shaped piece 10' are folded back by pressing the container with outwardly spread opening portion formed as described above by means of the female and male dies, the lip portion 13 can be easily formed. If the V-shaped piece 10' is made longer, and the upper parts are folded back together with V-shaped piece 10', there occur the cases where many wrinkles may be produced, or they may be broken, with the result that a fine lip portion 13 can not be formed.

In the above-mentioned embodiment, the lip portion 13 has semicircular cross-sections. This is because ring-shaped protruding lines with semicircular cross-sections are provided around the perimeter of the recess at the top level of the female die.

Figure 3:
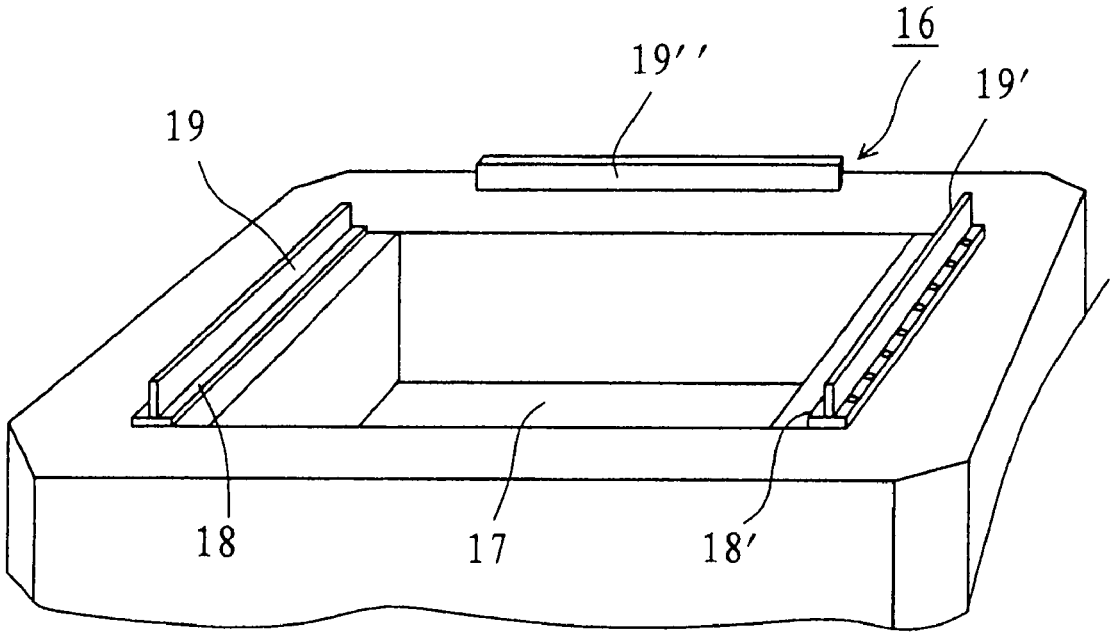
FIG. 3 is a perspective view illustrating an example of a female die to be used in the present invention.

FIG. 3 illustrates an example of a female die (concave die) 16 to be used in manufacturing according to the present invention, in which opposing sections at short side surfaces of the upper periphery of the concave section 17 of the female die 16 are provided with rods 18, 18' having square shapes in cross section in a manner opposing to each other and slightly spaced from the concave section 17. On the rods 18, 18', guiding boards 19, 19' are provided to stand thereon. At a backside of the concave section 17 of the female die 16, a guiding board 19" is provided to stand thereon.

The paperboard illustrated in FIG. 2 is placed so that the pair of short sidewall pieces 3*b*, 3*d* (not shown) is held between the guiding plates 19, 19' and one of the long sidewall pieces 3*a* or 3*c* is abutted on a guide plate 19" via the rods 18, 18' on the concave section 17 of the female die 16. Then, the male die (convex die) (which is not shown) is lowered and brought into fit with the concave section 17 of the female die 16 from the above to be subjected to the hot pressing process.

Accordingly, the pair of the opposing sidewall pieces 3*b*, 3*d* (not shown) is erected prior to the other pair of the opposing sidewall pieces 3*a*, 3*c*, and then the container can be manufactured in a single step by a complete fitting and the hot pressing process. Note that, as shown in FIG. 2, the lips 13*a*-13*d* provided at an upper edge and the concave sections 17 of the container are formed by the hot pressing process using the male and female dies.

In order to form the lips 12*c*'-13*d*' on the upper edge of the container, as shown in FIG. 3, the rods 18, 18' are away from the both side ends of the concave section by the distance corresponding to the lips. The concave section 17 may include steps formed thereon, and the male die is formed into a shape including the steps so as to fit into the concave section. The lips may be obviously formed utilizing the steps at which the female die and the male die are closely contacted with each other.

Manufacturing of containers shown in FIG. 1 requires that the concave section 17 is a long-shaped die in the longitudinal direction since the long sidewalls 3*b* and 3*d* have to be erected primarily.

A cover 14 can be formed with the container of the present invention. In the case of forming the cover, the cover may be formed with the sidewall piece (preferably with either one of the sidewall pieces 3, 3') as shown in FIG. 1.

As shown in FIG. 1, corner sections at four corners are thick because portions of the paperboard are superimposed on each other; consequently portions of the female die and/or the male die at which the corner sections are formed are preferred to be thinned by that amount.

The food containers manufactured by the method according to the present invention are not limited to, but are suitable for use as lunch boxes, fermented soybeans containers, trays, covers of the lunch boxes, and the like.

According to the present invention, the food container formed of the vegetable-fiber-made material and having practical strength can be produced commercially at low cost; therefore the container according to the present invention is sufficient enough as an alternative to the food container made of plastic, resulting in remarkably contributing to the environment protection.

Moreover overlapped bonding after cutting the material and coating the thermoplastic resin having heat sealing property only on the front surface causes liquid penetration from the cut surface of bonding portion at the corner, resulting in leakage and seeping. On the contrary, the container according to the present invention does not have such concern since there is no cut surface at the corners.

What is claimed is:

1. A method of manufacturing a food container or covers, comprising:

forming a board of a predetermined size from a material including at least one of pulp or vegetable fiber material other than pulp;

coating one surface of the paperboard article with thermoplastic resin having a heat sealing property;

forming substantially V-shaped foldout pieces each for connecting an adjacent pair of sidewall pieces at a respective one of four corners of the paperboard article; and forming the food container or cover by hot-pressing the paperboard article between a pair of male and female press dies;

wherein one pair of the sidewall pieces opposed to each other is configured to be erected ahead of a remaining pair of the sidewall pieces opposed to each other; and wherein each of the V-shaped foldout pieces includes a V-shaped foldout portion shorter than other portions of the paperboard article that are adjacent to both sides of the foldout piece, and at least a portion of the V-shaped foldout piece is overlapped or stuck to at least one of an adjacent one side of the V-shaped foldout piece or one of the sidewall pieces.

2. The method according to claim 1, wherein one side of the paperboard article that constitutes an inner peripheral or an outer peripheral surface of the food container or the cover to be formed is coated with the thermoplastic resin having the heat sealing property.

3. The method according to claim 1, wherein the foldout piece for connecting the adjacent sidewall pieces is bonded in an overlapping manner with the sidewall pieces while the foldout piece is folded upright.

4. The method according to claim 1, wherein the foldout piece for connecting sidewall pieces is formed into substantially V-shape, bent and overlapped in a chevron shape from the center of the V-shape, and overlapped or bonded with the sidewall pieces.

5. The method according to claim 4, wherein a notch is formed at the top end the folding portion to thereby define the V-shaped foldout portion shorter than other portions of the paperboard article on the abutting side of the folding portion against a one of the sidewall pieces in overlapping manner for bonding, after the substantially V-shaped folding portion is folded at the center thereof in a pyramidal shape, so that a portion corresponding to a notch of the rear surface of the other side of the folding portion is directly abutted for bonding against the front surface of said one of said sidewall pieces.

6. The method according to claim 1, wherein a notch is formed at a top end the folding portion on the abutting side of the against a one of the sidewall pieces in overlapping manner for bonding, after the substantially V-shaped folding portion is folded at the center thereof in a valley shape, so that a portion corresponding to a notch of the front surface of the other side of the folding portion is directly abutted for bonding against a rear surface of said one of said sidewall.

7. The method according to claim 1, wherein said V-shaped foldout portion shorter than other portions of the paperboard article is overlapped or bonded to a sidewall at a non-erected side by erecting one side of sidewall ahead of the other side.

8. The method according to claim 7, wherein a notch is formed at a top edge of the short V-shaped foldout piece, and the sidewalls erected, the V-shaped foldout piece is erected, then the V-shaped foldout piece is overlapped or bonded to the front surface of the sidewalls, a part of the sidewalls higher than the short V-shaped foldout piece is bonded to a rear surface of the sidewalls.

9. The method according to claim 1, wherein a convex portion is formed at one opposed section along a perimeter around a recess of the female die, and one pair of opposed sidewall pieces of the paperboard article placed on the convex portion is configured to be erected ahead of the other pair of the opposed sidewall pieces.

10. The method according to claim 1, wherein, before the pressing process begins, one pair of the opposed sidewall pieces is bent, and the one pair of the opposed sidewall pieces is configured to be erected ahead of the other pair of the opposed sidewall pieces.

11. The method according to claim 1, further comprising pressing the paperboard article by means of the female and male dies thereby to fold back upper parts other than the short V-shaped portions to form lip portions.

12. The method according to claim 1, wherein the material is pulp.

13. The method according to claim 1, wherein one pair of convex portions is formed at one of the opposed sections along a perimeter of a recess of the female die, and one of the pairs of opposed sidewall pieces is on the convex portions of the paperboard article and is erected ahead of the other pair of the opposed sidewall pieces.

14. The method according to claim 1, wherein, before the pressing process begins, one pair of the opposed sidewall pieces is bent, and the one pair of the opposed sidewall pieces is configured to be erected ahead of the other pair of the opposed sidewall pieces.

15. The method according to claim 1, wherein the thermoplastic resin comprises polyethylene or polypropylene.

16. A method of manufacturing a food container or cover, comprising:

providing a paperboard article of a particular shape which when folded defines a plate and sidewalls extending outward therefrom, said paperboard article being comprised of at least one material selected from the group consisting of pulp and vegetable fiber material other than pulp;

applying thermoplastic resin having a heat sealing property to the paperboard article on one side thereof; and defining a foldout portion adjoining each of adjacent ones of the sidewalls, said defining including forming a notch in an outer edge of said foldout portion such that at least a portion of said foldout portion is made shorter than both a first structural portion and a second structural portion present on a respective opposite side of the notch such than when said paperboard is folded at a boundary between said notch and each of said first and second structural portions to create an overlap of said first and second structural portions, a portion of said first structural portion which extends into a region defined by the notch is contactable, across the notch, with another portion of said second structural portion which extends into the region defined by the notch.

17. The method according to claim 16, further comprising:

forming the paperboard article into said food container or said cover by hot-pressing the paperboard article between a pair of male and female press dies.

* * * * *